US006070717A

United States Patent [19]

Philipson et al.

[11] Patent Number: 6,070,717

[45] Date of Patent: Jun. 6, 2000

[54] POINT OF SALE DISPLAY BOX AND KIT

[75] Inventors: Alan H. Philipson; Andre R. Philipson, both of New Orleans, La.

[73] Assignee: Superior Merchandise Company Inc., New Orleans, La.

[21] Appl. No.: 09/288,857

[22] Filed: Apr. 9, 1999

[51] Int. Cl.[7] ..... B65D 51/24; B65D 85/18; B65D 71/00; A44B 7/00

[52] U.S. Cl. ..... 206/45.28; 206/278; 206/348; 206/574; 220/241

[58] Field of Search ..... 206/278, 292, 206/348, 574, 459.5, 45.28; 220/241, 395.1, 350, 351

[56] References Cited

U.S. PATENT DOCUMENTS

| | | | |
|---|---|---|---|
| 173,360 | 2/1876 | Snider et al. . | |
| 226,392 | 4/1880 | Felbel | 206/459.5 |
| 242,319 | 5/1881 | Hershey . | |
| D. 385,781 | 11/1997 | Levine et al. . | |
| 906,638 | 12/1908 | Lehman | 206/278 |
| 939,721 | 11/1909 | Lewis . | |
| 1,036,661 | 8/1912 | Magee, Jr. | 206/278 |
| 1,480,427 | 1/1924 | Underwood | 206/564 |
| 2,006,415 | 7/1935 | Simon | 206/45.28 |
| 2,082,667 | 6/1937 | Vanderveld . | |
| 2,644,259 | 7/1953 | Beadle | 206/459.5 X |
| 3,563,370 | 2/1971 | Nozette et al. . | |
| 3,842,974 | 10/1974 | Jacobsen . | |
| 4,108,397 | 8/1978 | Hauck | 206/574 X |
| 4,413,726 | 11/1983 | Davidson . | |
| 4,504,407 | 3/1985 | Klutz, Jr. et al. . | |
| 5,163,547 | 11/1992 | Hsieh | 206/45.28 X |
| 5,271,552 | 12/1993 | McDonnell . | |
| 5,375,702 | 12/1994 | Fiallo . | |
| 5,394,983 | 3/1995 | Latulippe et al. | 206/459.5 X |
| 5,462,120 | 10/1995 | Colgate | 206/574 |

*Primary Examiner*—Bryon P. Gehman
*Attorney, Agent, or Firm*—Nixon & Vanderhye P.C.

[57] ABSTRACT

A point-of-sale display box and kit is partitioned to include a plurality of compartments for small item storage and display. A cover is selectively engageable with a top surface of the box and with a slot defined in slot extensions of the left and right side panels. With this construction, the point-of-sale display box is suitable for shipping or storage in a covered mode and also serves as a convenient display for retail sales. The cover and/or panels are preferably provided with display indicia to attract customers and for product advertising.

19 Claims, 3 Drawing Sheets

POINT OF SALE DISPLAY BOX AND KIT

BACKGROUND AND SUMMARY OF THE INVENTION

The present invention relates to a point-of-sale display box and kit and, more particularly, to a point-of-sale display box including a cover that contains the items during shipping and serves as a display backing during use.

In a retail selling establishment, small items must be contained in some type of container, and it is preferable to incorporate a display to attract customer attention. Retailers typically order large quantities of such items, requiring them to provide their own container and retail display.

It would thus be beneficial to provide a point-of-sale display box that is suitable for shipping large quantities of items and that can be readily converted to a display for a retail selling establishment. An object of the invention is to provide such a point-of-sale display box and a point-of-sale display kit incorporating the point-of-sale display box according to the invention. The display kit is particularly suited for shirt accessory items such as collar stays, collar extending buttons, and button pins.

According to one preferred aspect of the invention, a point-of-sale display box includes a bottom, sides, a front and a back collectively defining a containing space. The sides extend in substantially parallel relation from the front to the back and include slot extensions extending beyond the back. The slot extensions each includes a shoulder defining a slot therein. The box also includes at least one partition secured in the containing space and dividing the containing space into at least two compartments. A cover sized to cover the containing space with a thickness substantially corresponding to a width of the slots in the slot extensions is selectively engageable with a top surface of the side, the front and the back and with the slots in the slot extensions. The top surface of the sides, the front and the back preferably includes a step defining a shelf for supporting the cover. The step may have a depth substantially corresponding to the thickness of the cover, such that when the cover is engaged with the shelf, the cover is substantially flush with the top surface. One or more of the cover, the sides, the front and the back may be provided with display indicia relating to the contents in the display box.

Each of the slot extensions may be provided with a stop member in the slot, defining a depth of the slot. With the display indicia on the cover, the display indicia is disposed on the cover in an exposed area when the cover is engaged with the slot in the slot extensions.

In a point-of-sale display kit including the point-of-sale display box of the invention, at least one of collar stays and collar extending buttons is contained in the box compartments.

According to another aspect of the present invention, there is provided a point-of-sale display kit including a bottom, sides, a front, and a back collectively defining a containing space. The sides extend in substantially parallel relation from the front to the back and include slot extensions extending beyond the back. The slot extensions each includes a shoulder defining a slot therein. At least one partition is secured in the containing space and divides the containing space into at least two compartments. A plurality of collar stays are disposed in a first of the at least two compartments, and a plurality of collar extending buttons are disposed in a second of the at least two compartments. A cover sized to cover the containing space and having a thickness substantially corresponding to a width of the slots in the slot extensions is selectively engageable with the top surface of the sides, the front and the back and with the slots in the slot extensions. The partition may be T-shaped, dividing the containing space into three compartments. In this context, the display kit may further include a plurality of button pins disposed in a third of the three compartments.

In accordance with another aspect of the invention, there is provided a point-of-sale display box including a bottom defining a perimeter of the box in a bottom plane. A left side panel and a right side panel are attached to the bottom, wherein the left side panel and the right side panel extend beyond the perimeter of the box and define a rear slot. A front panel and a back panel, respectively, are attached to the bottom, the left side panel and the right side panel. The bottom, left side panel, right side panel, front panel and back panel collectively define a containing space, wherein a top surface of the left side panel, the right side panel, the front panel and the rear panel defines a top plane of the box. The rear slot is disposed behind the back panel relative to the front panel. A cover sized substantially corresponding to the perimeter to cover the containing space and having a thickness substantially corresponding to a width of the rear slot is selectively engageable with the top surface and the rear slot.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
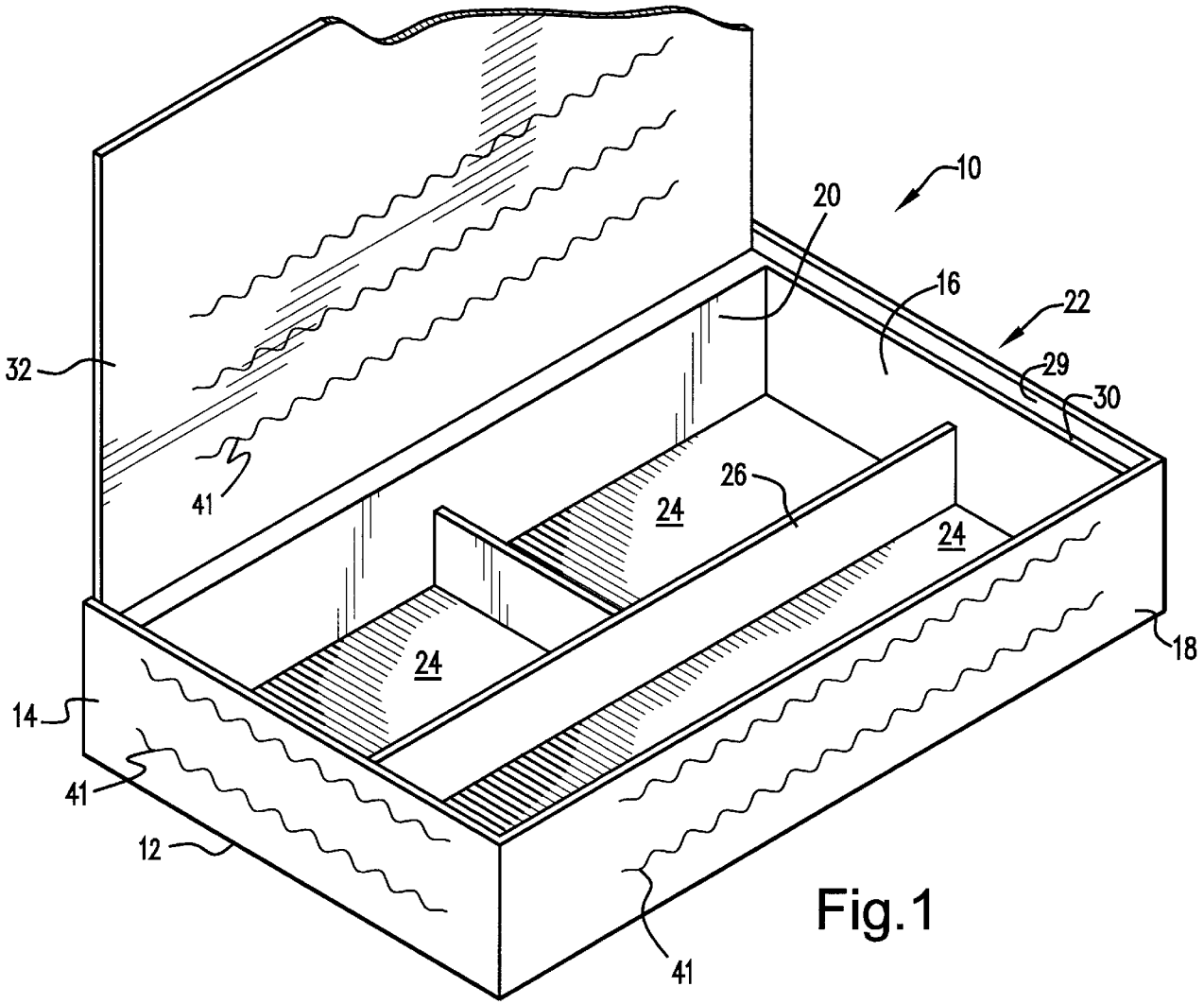
FIG. 1 is a perspective view of the point-of-sale display box according to the invention.

The point-of-sale display box according to the invention is shown in perspective in FIG. 1. The box 10 includes a bottom 12, a left side panel 14 (from the perspective in FIG. 1), a right side panel 16, a front panel 18 and a rear panel 20. The side panels or sides 14, 16, extend in substantially parallel relation from front to back and are secured to the bottom 12. The front panel or front 18 and the back panel or back 20 similarly extend in substantially parallel relation and are attached to the bottom 12. The panels 14, 16, 18, 20 are also preferably secured to one another, respectively. The bottom 12, sides 14, 16, front 18 and back 20 collectively define a containing space 22. The containing space 22 is divided into compartments 24 by at least one partition 26. In FIG. 1, the partition 26 is T-shaped, dividing the containing space 22 into three compartments 24.

Figure 2:
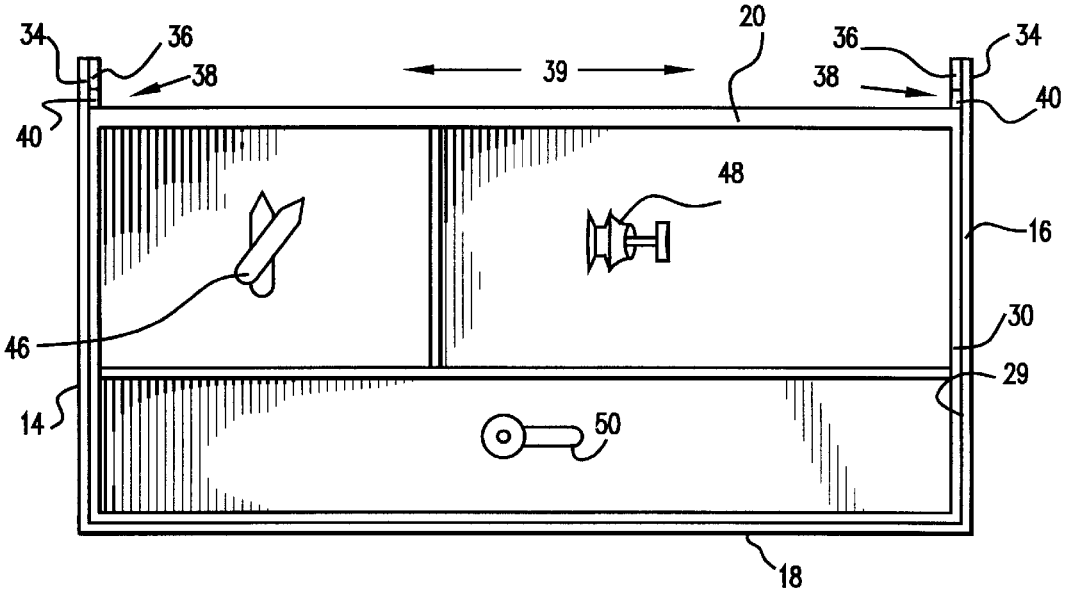
FIG. 2 is a top plan view of the display box according to the invention without the cover.
Figure 3:
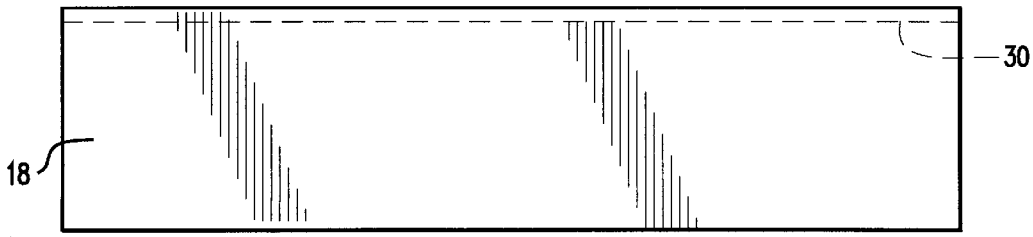
FIG. 3 is a front elevation view of the display box.
Figure 4:
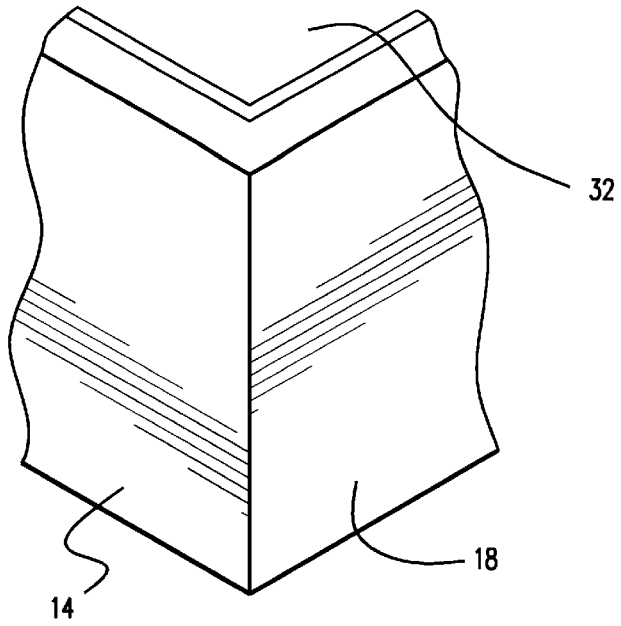
FIG. 4 is a perspective view of a front comer of the display box showing the cover substantially flush with the top surface.

With continued reference to FIG. 1 and with reference to FIGS. 2 and 3, a top plane or top surface of the sides 14, 16, the front 18, and the back 20 includes a step 29 defining a shelf 30. The shelf 30 supports a cover 32 that is sized to cover the containing space 22. The step has a depth substantially corresponding to the thickness of the cover 32, such that when the cover 32 is engaged with the shelf 30, the cover is substantially flush with the top surface of the sides 14, 16, the front 18 and the back 20 as shown in FIG. 4.

Figure 5:
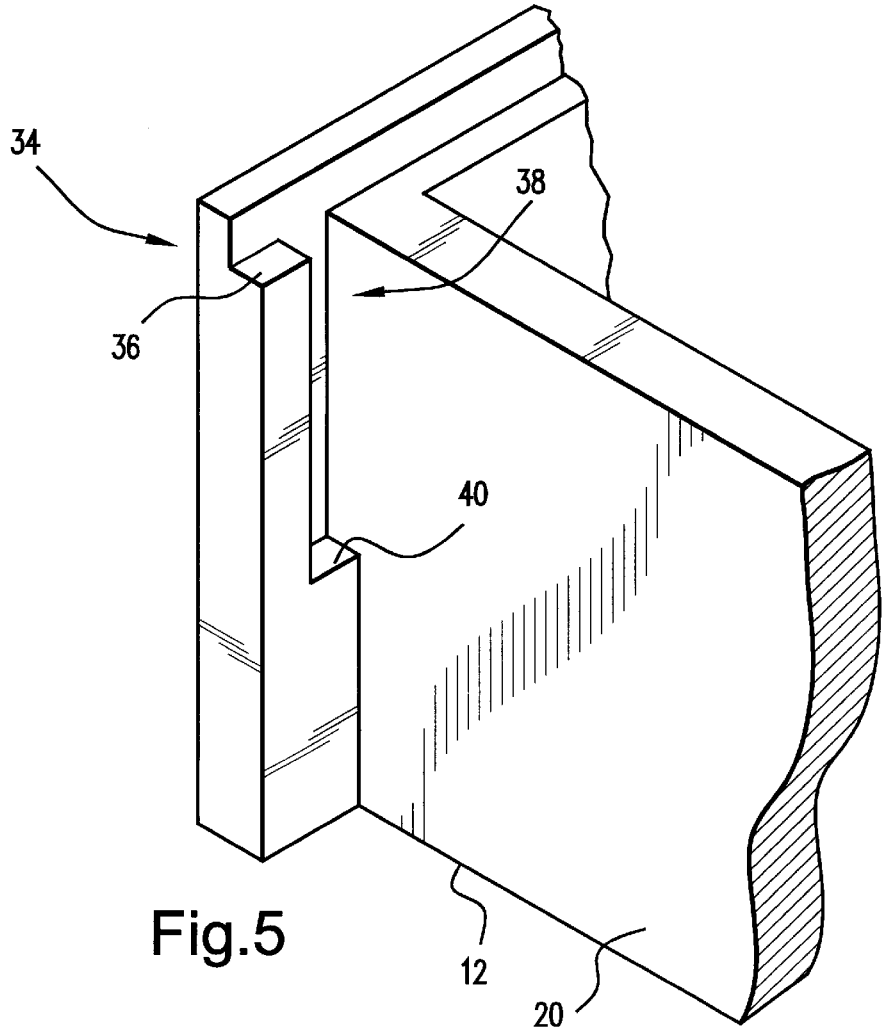
FIG. 5 is a perspective view from the rear of the display box showing the slot for the cover.

Referring to FIGS. 2 and 5, the bottom 12 defines a perimeter of the box in a bottom plane. The sides 14, 16 include slot extensions 34 that extend beyond the back 20 of the box, i.e., beyond the perimeter of the box. The slot extensions 34 each includes a shoulder 36 defining a slot 38 therein. The slots 38 together define a single rear slot 39 for receiving the cover 32. The width of the slots 38 substantially corresponds to the thickness of the cover 32 such that the cover 32 can be received in the slot rear slot 39 defined by the slots 38 in the slot extensions 34. For a proper fit, of course, the width of the slot is slightly greater than the thickness of the cover, but for the purposes of the present application, the thickness of the cover 32 substantially corresponds to the width of the slots 38.

Each of the slot extensions 34 also includes a stop member 40 in the slot 38 that defines a depth of the slot 38. In the display arrangement, the cover 32 is received by the slots 38 and rests on the stop members 40 such that a majority of the cover 32 is disposed above the back 20 in plain view for display.

The cover 32 is thus selectively engageable with the top surface of the sides, the front and the back, and with the slots 38 in the slot extensions 34. During shipping, the cover is positioned in its covered arrangement engaging the shelf 30 of the top surface. When the display box has reached its destination where the products will be sold, the cover 32 is engaged with the slots 38 formed in the slot extensions 34. Preferably, the cover is provided with display indicia 41 such as advertising or the like for the items in the display box on one or both sides of the cover. On at least one side of the cover 32, the display indicia is particularly disposed in an exposed area when the cover is engaged with the slots 38 in the slot extensions 34. Additional display indicia may be provided on the exterior faces of at least one of the sides 14, 16, the front 18 or the back 20.

In a display kit according to the invention, the display box is provided with one or more of collar stays 46, button pins 48 or collar extending buttons 50. Of course, the items in the point-of-sale display kit according to the invention are exemplary, and the invention is not necessarily meant to be limited to the described and illustrated products.

With the structure according to the present invention, a point-of-sale display box can be readily converted between a shipping or storage container to a convenient point-of-sale display. The cover is selectively engageable with a shelf in the top surface of the box in a shipping or storage mode and with a slot defined by slot extensions in the sides of the box in a display mode. The point-of-sale display kit preferably contains items such as accessories for shirts.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A point-of-sale display box comprising:

a bottom, sides, a front, and a back collectively defining a containing space, the sides extending in substantially parallel relation from the front to the back and including slot extensions extending beyond the back, wherein the slot extensions each includes a shoulder defining a slot therein;

at least one partition secured in the containing space and dividing the containing space into at least two compartments; and a cover sized to cover the containing space, the cover having a thickness substantially corresponding to a width of the slots in the slot extensions, wherein the cover is selectively engageable with a top surface of the sides, the front and the back and with the slots in the slot extensions.

2. A point-of-sale display box according to claim 1, wherein the top surface of the sides, the front and the back comprises a step defining a shelf for supporting the cover.

3. A point-of-sale display box according to claim 2, wherein the step has a depth substantially corresponding to the thickness of the cover, such that when the cover is engaged with the shelf, the cover is substantially flush with the top surface.

4. A point-of-sale display box according to claim 1, wherein the cover comprises display indicia on at least one side thereof.

5. A point-of-sale display box according to claim 4, wherein an exterior face of at least one of the sides, the front and the back comprises display indicia.

6. A point-of-sale display box according to claim 4, wherein each of the slot extensions further comprises a stop member in its respective slot, the stop members defining a depth of the slots, and wherein the display indicia is disposed on the cover in an exposed area when the cover is engaged with the slots in the slot extensions.

7. A point-of-sale display box according to claim 1, wherein each of the slot extensions further comprises a stop member in its respective slot, the stop members defining a depth of the slots.

8. A point-of-sale display kit including a point-of-sale display box comprising:

a bottom, sides, a front, and a back collectively defining a containing space, the sides extending in substantially parallel relation from the front to the back and including slot extensions extending beyond the back, wherein the slot extensions each includes a shoulder defining a slot therein;

at least one partition secured in the containing space and dividing the containing space into at least two compartments;

a cover sized to cover the containing space, the cover having a thickness substantially corresponding to a width of the slots in the slot extensions, wherein the cover is selectively engageable with a top surface of the sides, the front and the back and with the slots in the slot extensions; and at least one of collar stays and collar extending buttons.

9. A point-of-sale display kit comprising:

a bottom, sides, a front, and a back collectively defining a containing space, the sides extending in substantially parallel relation from the front to the back and including slot extensions extending beyond the back, wherein the slot extensions each includes a shoulder defining a slot therein;

at least one partition secured in the containing space and dividing the containing space into at least two compartments;

a plurality of collar stays disposed in a first of the at least two compartments;

a plurality of collar extending buttons disposed in a second of the at least two compartments; and a cover sized to cover the containing space, the cover having a thickness substantially corresponding to a width of the slots in the slot extensions, wherein the cover is selectively engageable with a top surface of the sides, the front and the back and with the slots in the slot extensions.

10. A point-of-sale display kit according to claim 9, wherein the partition is T-shaped, dividing the containing space into three compartments, the display kit further comprising a plurality of button pins disposed in a third of the three compartments.

11. A point-of-sale display box comprising:

a bottom defining a perimeter of the box in a bottom plane;

a left side panel and a right side panel attached to the bottom, wherein the left side panel and the right side panel extend beyond the perimeter of the box and define a rear slot;

a front panel and a back panel respectively attached to the bottom, the left side panel and the right side panel, the bottom, left side panel, right side panel, front panel, and back panel collectively defining a containing space, wherein a top surface of the left side panel, right side panel, front panel and rear panel defines a top plane of the box, and wherein the rear slot is disposed behind the back panel relative to the front panel; and a cover sized substantially corresponding to the perimeter to cover the containing space, the cover having a thickness substantially corresponding to a width of the rear slot, wherein the cover is selectively engageable with the top surface and the rear slot.

12. A point-of-sale display box according to claim 11, wherein the top surface comprises a step defining a shelf for supporting the cover.

13. A point-of-sale display box according to claim 12, wherein the step has a depth substantially corresponding to the thickness of the cover, such that when the cover is engaged with the shelf, the cover is substantially flush with the top surface in the top plane of the box.

14. A point-of-sale display box according to claim 11, wherein the cover comprises display indicia on at least one side thereof.

15. A point-of-sale display box according to claim 14, wherein an exterior face of at least one of the left side panel, right side panel, front sides, the front and the back comprises display indicia.

16. A point-of-sale display box according to claim 14, wherein the slot further comprises a stop member defining a depth of the slot, and wherein the display indicia is disposed on the cover in an exposed area when the cover is engaged with the slot.

17. A point-of-sale display box according to claim 11, wherein the slot further comprises a stop member defining a depth of the slot.

18. A point-of-sale display kit including a point-of-sale display box comprising:

a bottom defining a perimeter of the box in a bottom plane;

a left side panel and a right side panel attached to the bottom, wherein the left side panel and the right side panel extend beyond the perimeter of the box and define a rear slot;

a front panel and a back panel respectively attached to the bottom, the left side panel and the right side panel, the bottom, left side panel, right side panel, front panel, and back panel collectively defining a containing space, wherein a top surface of the left side panel, right side panel, front panel and rear panel defines a top plane of the box, and wherein the rear slot is disposed behind the back panel relative to the front panel;

a cover sized substantially corresponding to the perimeter to cover the containing space, the cover having a thickness substantially corresponding to a width of the rear slot, wherein the cover is selectively engageable with the top surface and the rear slot; and at least one of collar stays and collar extending buttons.

19. A point-of-sale display kit according to claim 18, further comprising button pins.

* * * * *